United States Patent [19]

Stein

[11] 4,078,692

[45] Mar. 14, 1978

[54] CONTAINER WITH INTEGRAL STRAW

[76] Inventor: Elias H. Stein, 726 Market St., Philadelphia, Pa. 19106

[21] Appl. No.: 750,443

[22] Filed: Dec. 14, 1976

[51] Int. Cl.[2] ..... A47G 19/22

[52] U.S. Cl. ..... 220/90.2; 220/270; 229/7 S; 215/1 A

[58] Field of Search ..... 220/269, 270, 90.2; 229/7 S; 215/1 A

[56] References Cited

U.S. PATENT DOCUMENTS

| | | | |
|---|---|---|---|
| 3,656,654 | 4/1972 | Brinkley | 229/7 S X |
| 3,717,476 | 2/1973 | Harvey | 229/7 S X |
| 3,946,895 | 3/1976 | Pugh | 220/269 |

*Primary Examiner*—George T. Hall

*Attorney, Agent, or Firm*—Weiser, Stapler & Spivak

[57] ABSTRACT

A container with integral straw wherein a plastic or other material straw is packaged within the container either when the container is manufactured or when the container is filled. A portion of the straw is removably secured interiorly of the container to the pull tab opener wherein the upper end of the straw is automatically pulled exteriorly of the container when the pull tab is removed to expose the container contents.

19 Claims, 10 Drawing Figures

FIG. 1
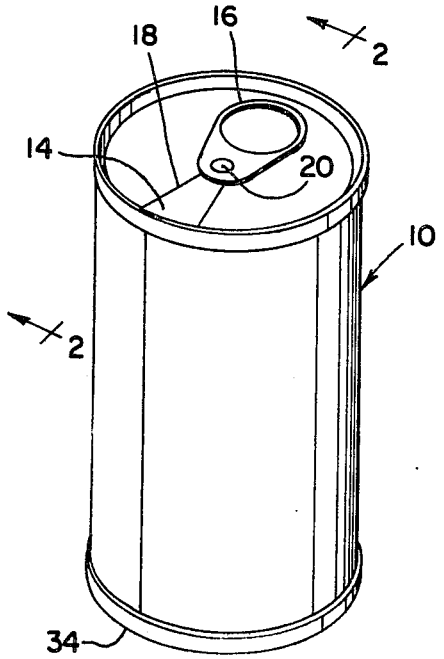
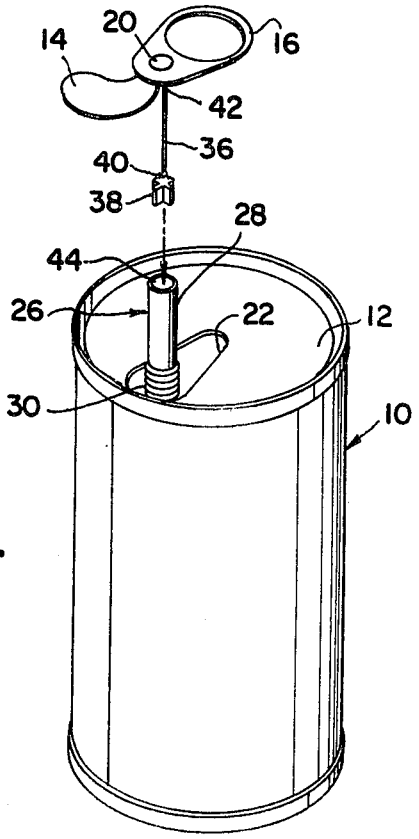
FIG. 4
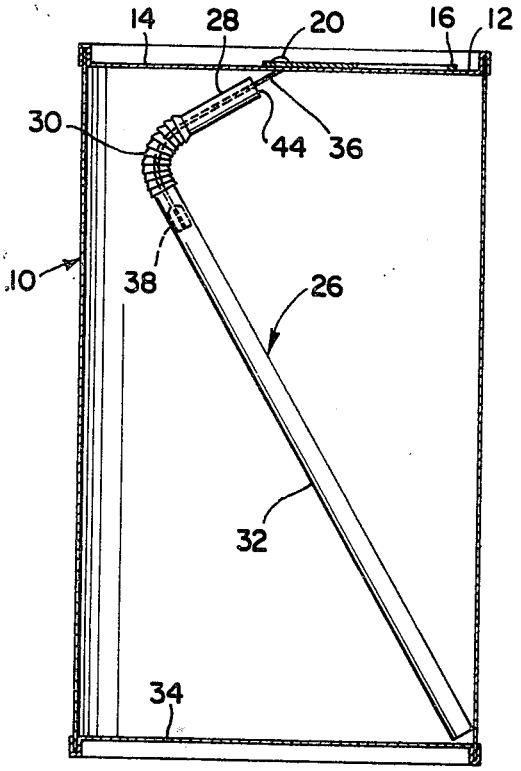
FIG. 2
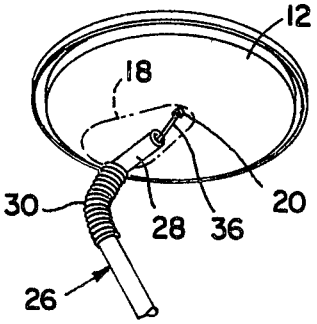
FIG. 3
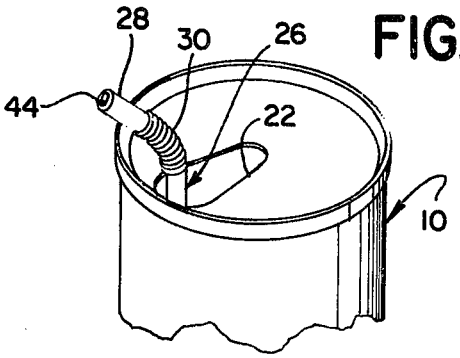
FIG. 5

FIG. 6
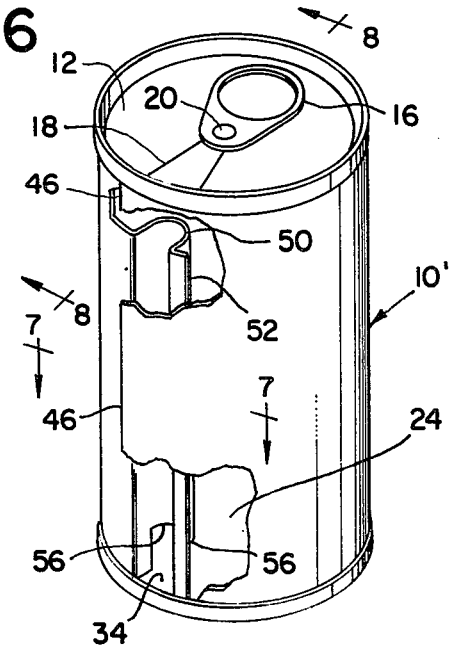
FIG. 10
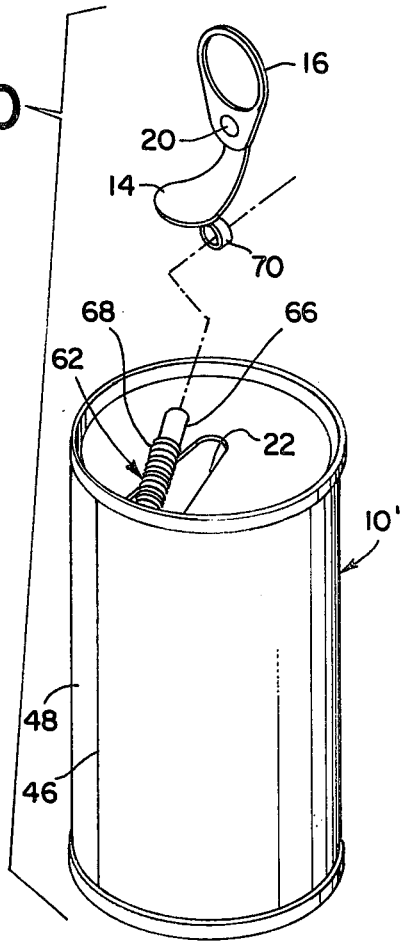
FIG. 7
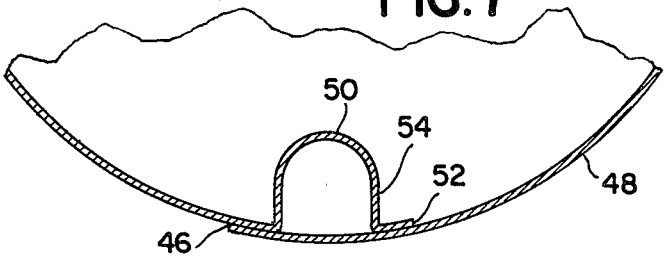
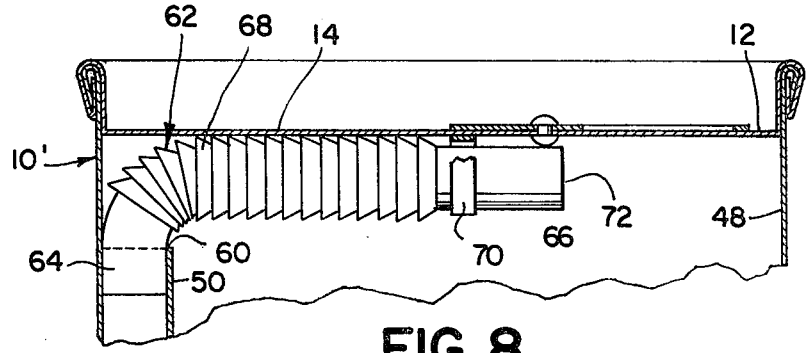
FIG. 8
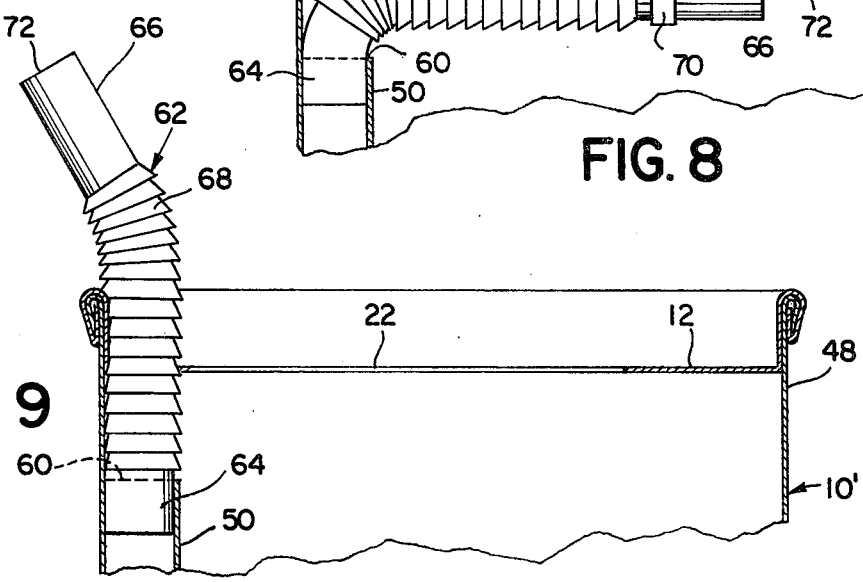
FIG. 9

CONTAINER WITH INTEGRAL STRAW

BACKGROUND OF THE INVENTION

The invention relates generally to the combination of a container with integral straw wherein the straw is packaged with a container such as a beverage can, either when the can is manufactured or when the container is filled.

The invention relates primarily to beverage cans of the type which incorporate a pull tab and pull ring wherein the ring is pulled to separate the tab from the container top along a weakened seam to thereby expose the container contents. In most prior art types of containers of the pull tab type, after a portion of the container top was removed along the weakened seam, it was then necessary to secure and insert a separate straw in order to conveniently sip the liquid contents of the can. Optionally, it has also been the common practice to pour the container contents into a separate glass for drinking purposes.

Prior workers in the art have attempted to developed beverage containers with integral straws as exemplified in U.S. Pat. Nos. 3,303,984, 3,486,679, 3,559,868, 3,362,607, 3,303,985, 3,558,033, 3,406,868, 3,462,061 and 3,774,804. Most of the above cited patents relate to cardboard or plastic containers and are not adaptable for use with conventional metallic containers of the steel or aluminum type. The prior art devices are further deficient in that they are not compatable with existing manufacturing and filling facilities, and accordingly, will require special equipment and special handling prior to employment.

SUMMARY OF THE INVENTION

The present invention relates generally to the beverage dispensing industry, and more particularly is directed to a beverage can which includes an integral straw which is automatically exposed when the container is opened for use.

The present invention utilizes substantially all of the structure and design of containers that are presently available and can be manufactured and filled utilizing equipment that is presently in use and currently available with little additional structural changes and procedural techniques.

In one embodiment of the invention, a flexible cord is affixed at one end to the conventional pull ring and pull tab at the juncture thereof. The other end of the flexible cord comprises an enlarged pull device which is fabricated of suitable diameter to conveniently fit interiorly of a straw to provide frictional engagement there within. A plastic straw of the type including a corrugated bendable section is inserted within the container with the pull device engaged within at least a portion of the corrugated section. When the container is opened by pulling the pull ring upwardly to remove the removable tab along the conventional weakened seam thereof, the upward movement of the pull ring pulls the flexible cord upward also. The affixed pull device then acts to pull the straw upwardly to expose the upper end of a straw through the container opening. The straw can then be bent about the corrugated section as desired for beverage sipping purposes.

In another embodiment of the invention, a beverage container of the type employing a vertical seam for closure purposes is utilized. The vertical seam is reworked as necessary to provide a vertical conduit having an opening near the bottom and an upper opening spaced downwardly from the container top. A plastic straw frictionally inserts into the top of the container conduit and also includes a bendable section of the corrugated type. The straw is bent interiorly of the container along the corrugated section in a manner to removably engage a loop or other straw holding construction. Thus, when the pull ring and pull tab are removed in conventional manner, the engagement between the pull tab and the straw serves to pull the upper end of the straw upwardly as the pull tab is removed to pull the upper end of the straw through the container opening for sipping purposes. The internal, metallic, vertical conduit formed by the container vertical seam acts as a continuation of the straw to permit sipping of the container contents through the conduit comprising the metallic, internal conduit and the plastic straw affixed at the upper end of the conduit.

It is therefore an object of the present invention to provide an improved container with integral straw of the type set forth.

It is another object of the present invention to provide a novel container with integral straw which may be manufactured and filled using existing container filling and manufacturing apparatus.

It is another object of the present invention to provide a novel contaner with integral straw which comprises a bendable straw positioned interiorly of the container and a flexible cord extending between a portion of the straw and a portion of the container pull tab wherein the straw is automatically pulled outwardly of the container when the pull tab is removed.

It is another object of the present invention to provide a novel container and integral straw wherein the straw includes a bendable section and the container comprises a flexible cord affixed to the pull ring, wherein one end of the flexible cord extending interiorly of the straw to within the bendable section to frictionally engage the straw whereby the end of the straw is pulled from the container when the pull ring is removed.

It is another object of the present invention to provide a novel container with integral straw comprising an internally positioned straw having a bendable section, a flexible cord affixed at one end to the conventional container pull ring, the flexible cord having affixed at the other end, a pull device wherein the pull device frictionally engages the straw at the bendable section to pull the straw from the container when the container is opened.

It is another object of the present invention to provide a plastic straw positioned interiorally of the container, the said straw containing near the top thereof a corrugated bendable section, the container being provided with a flexible cord which is affixed at one end to the usual pull ring and which is provided at the other end with a pull device. The pull device being inserted interiorally of the straw to engage the straw frictionally in the corrugated area so that the straw is pulled upward from the container when the pull ring is removed to expose the container contents.

It is another object of the present invention to provide a container with integral straw wherein a portion of the container itself is formed to provide a vertical conduit and wherein a straw is inserted into the upper end of the conduit to form a combination, continuous conduit for beverage sipping purposes.

It is another object of the present invention to provide a novel container with integral straw comprising a beverage sipping conduit comprised partly of metallic conduit and partly of plastic conduit. It is another object of the present invention to provide a novel container with integral straw which comprises a metallic conduit formed as the container itself is formed, said conduit having a bottom opening positioned near the bottom of the container, a top opening spaced downwardly from the container top and a plastic straw frictionally engageable within the top of the metallic conduit, the said plastic straw having a corrugated bendable section which is removably engagable with the pull tab construction of the container whereby at least a portion of the straw is exposed through the contaner opening when the pull tab is removed for beverage sipping purposes.

It is another object of the present invention to provide a novel container with integral straw that is inexpensive in manufacture, simple in design and trouble free when in use.

Other objects and a fuller understanding of the invention will be had by referring to the following description and claims of a preferred embodiment thereof taken in conjunction with the accompanying drawings wherein like reference characters refer to similar parts throughout the several views and in which:

FIG. 1 is a perspective view of a container including an integral straw fabricated in accordance with the present invention.

FIG. 2 is a cross-sectional view taken along line 2—2 of FIG. 1 looking in the direction of the arrows.

FIG. 3 is a bottom perspective view showing a container top with the straw connected.

FIG. 4 is an exploded perspective view of the invention with the pull tab and pull ring removed.

FIG. 5 is a partial perspective view of the container of FIG. 4 showing the straw ready for use.

FIG. 6 is a perspective view of a modified container construction including an integral straw and partly broken away to expose interior construction details.

FIG. 7 is an enlarged, partial, cross-sectional view, taken along line 7–7 of FIG. 6 looking in the direction of the arrows.

FIG. 8 is an enlarged, partial, cross-sectional view, taken along line 8—8 of FIG. 6, looking in the direction of the arrows.

FIG. 9 is an enlarged, partial, cross-sectional view similar to FIG. 8 showing the end of the straw positioned exteriorly of the container after the pull ring and pull tab have been removed.

FIG. 10 is a perspective view similar to FIG. 6 showing the removal of the pull ring and pull tab in exploded relationship and the immergence of the top end of the straw from the container.

DESCRIPTION OF THE PREFERRED EMBODIMENTS OF THE INVENTION

Although specific terms are used in the following description for the sake of clarity, these terms are intended to refer only to the particular structure of the invention selected for illustration of the drawings and are not intended to define or limit the scope of the invention.

As used herein, the terms "riveted connection", "rivet" or similar designations are not limited to conventional rivets per se, but are herein defined to mean any type of interconnection between the pull ring and the pull tab suitable to interconnect the parts and which may be formed by such processes as riveting, spot welding, punching, swaging, grommets or other common mechanical or chemical fastening methods.

Referring now to the drawings, there is shown in in FIG. 1 a container 10 which is essentially conventional in configuration and which may be either of the seamed metallic type or of the aluminum non-seamed type. The container terminates upwardly in a conventional top 12 which is provided with a conventional pull tab 14 which is defined from the top construction 12 by a weakened seam 18 in well known manner. A pull ring 16 of substantially non-bendable construction affixes to the pull tab 14 in conventional manner such as by applying a rivet 20 or other suitable construction to securely affix the pull ring 16 to the pull tab 14. Thus, by pulling upwardly on the pull ring 16 relative to the top 12 of the beverage container 10, the tab 14 can be removed in conventional manner along the weakened seam 18 thereby to conventionally provide a top opening 22 through which the container contents 24 (FIG. 6) can be removed.

A paper or plastic drinking straw is positioned interiorally of the container 10 and is equipped with suitable construction to pull the straw end 28 exteriorally of the container and through the top opening 22 when the pull ring 16 and pull tab 14 are upwardly urged to expose the container contents. The straw 26 preferably is fabricated of plastic or treated paper of material suitable for emersing in beverages, both of the carbonated and non-carbonated types, for extensive lengths of time without deterioration, wear, softening, discoloration or any other type of decomposition that may provide detrimental either to the beverage itself or to the user of the straw when the container is opened. Polyethylene plastic straws and coated paper straws comprise types of materials that have been found suitable for the purpose. However, the invention is not limited to these particular materials, but rather encompasses all types of materials which may be formed into straws and which are suitable for the purpose.

As is seen in FIGS. 2 and 3, the straw 26 is preferably fabricated with a corrugated portion 30 intermediate the upper end or drinking end 28 and the elongated straw body 32 which extends within the interior of the container 10 to near the bottom 34 thereof. The straw 26 is fabricated with a smooth, relatively rigid, end lengths 28, 32 and an intermediate corrugated portion 30 which is made flexible by corragating the same peripherally with grooves. The corrugated portion 30 is fabricated by techniques well known to those skilled in the art to permit the straw to assume and maintained a shape at the corrugated portion 30 thereof as it is bent. For example, see FIGS. 2, 3 and 5 wherein the drinking straw 26 is bent to substantially a V-shape at the corrugated portion 30 thereof. In FIG. 4, the drinking straw 26 is depicted in substantially linear arrangement as it is urged outwardly of the container 10 by function of the pull ring and pull tab 16,14.

Referring still to FIGS. 2, 3 and 4, there is illustrated a flexible cord 36 which is affixed at one end 42 to the pull ring 16 and the pull tab 14 at the usual riveted connection 20 thereof. The cord 36 is preferably fabricated of a length of thin, flexible, plastic cord, such as polyethylene plastic or other suitable plastic that is entirely inert and unaffected by the beverage 24 contained within the container 10. The other end 40 of the cord 36 integrally attaches to a pull device 38 which also is fabricated of material completely inert to the container contents 24. Preferably, the cord 36 and the pull device 38 are integrally formed the same material. The cord material, which may be polyethylene plastic should be of suitable strength to facilitate pulling the straw 26 through the container opening 22 in the manner hereinafter fully set forth. The second end 42 of the cord 36 is affixed to the pull tab 14 and the pull ring 16 in a manner to pull the cord 36 outwardly of the container 10 when the pull ring and pull tab 16, 14 are removed. Preferably, the end 42 is affixed directly into the riveted connection 20 utilizing the same machinery and same techniques that are presently employed to affix the pull tab 14 to the pull ring 16. It is contemplated that the connection of the cord end 42 to the rivet 20 can be made completely mechanically without the need for cement or other fastening. However, suitable cement that is inert to the effects of the beverage 24 could also be employed to affix the cord end 42 if so desired.

The pull device 28 may be triangular, rectangular, circular, star shaped, etc. in cross-sectional configuration. The external, diametrical dimensions of the pull device 38 should be sufficient to engage interiorly of the corrugated portion 30 and to be a friction fit therewithin.

As best seen in FIGS. 2 and 3, the straw 26 is illustrated in bent configuration about the corrugated section 30 to fit interiorly of the container 10. It is noteworthy that the total length of the drinking straw 26 is greated than the height of the container 10 so that the straw 26 must be bent when inserted interiorly of the container. The flexible cord 36 with the pull device 38 attached is inserted through the open end 44 of the drinking portion 28 of the straw 26 a sufficient distance to permit the pull device 38 to engage frictionally upon one or more of the corrugations comprising the corrugated section 30. The cord 36 should be of sufficient length to enable the pull device 38 to be inserted into the upper end section 28 of the straw 26 through all or substantially all of the corrugated portion 30. In the preferred embodiment, the pull device is inserted within the straw to a distance that is below the bend in the corrugated portion 30. The bent configuration of the corrugated portion 30 as illustrated in FIG. 2 further serves to cause frictional engagement of the pull device 38 upon the interior of the corrugated portion 30 assure that the straw upper end 28 will be pulled from the container when the pull tab is removed. See FIG. 4.

As illustrated in FIG. 4, when the pull ring 16 is pulled relative to the container 10 in conventional manner to remove the pull tab 14 and thereby expose the upper opening 22, the pull cord 36 will follow the pull ring 16 exteriorally of the container inasmuch as the end 42 is connected at the rivet 20. Upward urging of the pull ring 16 relative to the container 10 pulls the upper portion 28 of the drinking straw 26 through the container opening 22 by unbending the corrugated section 30. As the straw 26 becomes straightened by unbending at the corrugated section 30, the frictional engagement of the pull device 38 within the interior of the corrugated section 30 can be overcome by outward urging of the pull ring to thereby pull the pull device 38 upwardly through the upper end 28 of the straw 26. This upward urging of the pull device 28 causes the straw to assume a substantially linear shape as best seen in FIG. 4, with the upper end 28 extending through the container opening 22. As above set forth, the overall length of the straw 26 is preferably greated than the height of the container 10 so that the straw will be positioned ready for use when the pull ring 16 is removed. After removal of the pull ring 16 and pull tab 14, the upper end 28 of the drinking straw 26 may be positioned in any desired location by bending about the corrugated section 30 as illustrated in FIG. 5.

In use, it is contemplated that existing container fabrication and container filling equipment will be utilized and that the present invention will be entirely compatable for use with such existing equipment with but minor modifications. In one well known manufacturing technique, the pull ring and pull tab are fabricated in the container top 12 and then the top 12 is applied to the body of the container. In utilizing this same technique, as best seen in FIG. 3, it is further contemplated that one end 42 of the pull cord 36 will be affixed to the rivet 20 and the pull device 38 will be positioned interiorly of the drinking straw 26 prior to affixing the container top 12 to the sidewalls of the container 10. It is contemplated that the operations of affixing the end 42 of the pull cord 36 to the rivet 20 and the insertion of the first end 40 of the pull cord 36 with the pull device 38 interiorly of the straw 26 will all be done automatically by mechanical equipment at the least possible cost and without any delay in the present container fabrication operation.

Referring now to FIG. 6, there is illustrated a modified container 10' which is equipped with a container top 12 having a pull ring 16 affixed to a pull tab 14 at a rivet 20 in conventional manner. Container 10' comprises a longitudinal, vertical seam 46 in accordance with well known container construction techniques.

As best seen in FIG. 7, the container 10' comprises a lap joint at the vertical seam 46 wherein one end 54 of the side wall construction 48 is elongated and is bent inwardly and cylindrically to define an interior conduit 50. The elongated flap 54 is endwardly soldered, welded or otherwise affixed interiorly of the container 10'. The flap can be cylindrically bent utilizing existing can fabrication equipment to form a hollow vertical, interior conduit 50 for beverage drinking purposes as hereinafter fully set forth. The conduit 50 terminates downwardly at a bottom end 56 which is positioned near the bottom 34 of the container thereby permitting substantially all of the liquid contents 24 of the container to be drawn upwardly therethrough. The conduit 50 terminates upwardly in an upper end 60 (FIG. 8) which is spaced from the container top 12 a sufficient distance to permit the installation of a short length of drinking straw 62.

The short straw 62 is preferably fabricated of plastic or treated paper of known construction that is suitable for use and completely inert within the container so that there will be no deterioration or other unwanted wear when the short straw 62 is positioned interiorly of the container 10'. The short straw 62 comprises an interior end 64, an exterior end 66 and a corrugated, flexible portion 68 extending therebetween. The dimensions of the interior of the conduit 50 and the exterior dimensions of the interior end 64 of the short straw 62 correspond and are designed to permit the interior end 64 to be inserted into the top 60 of the conduit 50 and to be a frictional engagement therein. It is contemplated that prior to affixing the container top 12 to the container sidewalls 48, the end 64 of the short straw 62 will be inserted into the open top 60 of the interior conduit 50 wherein it will be frictionally held at all times, both when the container is filled and after removal of the pull tab 14 for emptying of the container contents 24.

A band 70 may be affixed to the pull ring 16 and pull tab 14 construction for straw pulling purposes. The band is fabricated of size to encircle the exterior end 66 of the short straw 62 when the straw is packed interiorly of the container 10'. Removal of the pull ring 16 and the pull tab 14 will thus cause the exterior end 66 of the short straw 62 to project upwardly out of the container opening 24 as the pull tab 14 and the affixed band 70 are removed. See FIG. 10.

Removal of the pull ring 16 and pull tab 14 urges the exterior end 66 of the straw 62 outwardly of the container 10' by bending the short straw 62 about the corrugated portion 68 to any desired position for convenience in drinking as best seen in FIG. 9. As above set forth, the frictional engagement of the interior end 64 of the short straw 62 within the top 60 of the conduit 50 maintains the engagement between the straw 62 and the conduit 50. Thus, by sipping on the exterior end 66 of the short straw 62, the liquid contents 24 of the container 10' can be withdrawn through the combination of the short straw 62 and vertical conduit 50. The liquid contents 24 will enter the conduit 50 through the bottom opening 56 thereof and will exit through the open end 72 of the straw 62.

In addition to the band 70 as illustrated in FIGS. 8 and 10, it is contemplated that other constructions may also be employed to pull the exterior end 66 of the straw outwardly of the container 10' when the pull ring 16 and pull tab 14 are removed. In lieu of the band 70, it is contemplated that a flexible pull cord 36 with pull device 38 could be employed in this modified construction in a manner similar to that illustrated in FIGS. 2 - 5. Additionally, in lieu of an encircling band 70, it is contemplated that a hook (not illustrated) could be affixed at the rivet 30 to extend interiorly of the straw 20 through the open end 72 thereof. The hook would be a loose engagement through the open end 72 to pull the exterior end 66 upwardly when the pull ring 16 is pulled upwardly. The loose engagement of the hook within the interior of the straw 62 would be sufficient to pull the exterior end 66 upwardly to the position illustrated in FIG. 10. The loose engagement would then enable the pull ring 16 and pull tab 14 to be disassociated from the open end 72 of the short straw 62 for disposal in the usual manner. In the manner above set forth, the frictional engagement of the short straw 62 within the interior conduit 50 would maintain the interior end 64 of the straw 62 within the container 10' for beverage sipping purposes.

Although the present invention has been described with reference to the particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification, but rather, only by the scope of the claims appended hereto.

What is claimed is:

1. In a liquid container of the type including an enclosing sidewall, a metallic top and an integral opener in the top wherein the opener comprises a pull ring affixed to a pull tab in a junction and wherein the pull tab is defined in the top by a weakened seam, the improvement which comprises a straw packaged within the container below the top, said straw having one end adapted to be pulled above the top through an opening when the pull ring and pull tab are removed to form the opening.

said straw having a second end adapted to remain interiorly of the container within the liquid for liquid sipping purposes, said straw comprising a corrugated bendable section, the straw being bent at the bendable section within the container to define a bent portion;

pull means releasably interconnecting one of the pull ring or pull tab to the straw to pull the said one end exteriorly of the container when the pull tab is separated from the container top along the said weakened seam, the pull means comprising a flexible cord having an interconnected end and a free end, a pull device affixed to the free end, the pull device being adapted to be inserted into the said one end of the straw and adapted to engage the corrugated bendable section, whereby the one end of the straw is pulled outwardly of the container when the pull tab is removed from the container top.

2. The liquid container according to claim 1 wherein the pull means affixes to the pull tab and pull ring at the said junction thereof.

3. The liquid container according to claim 2 wherein the pull means comprises a flexible cord, said cord being free to flex relative to the pull tab.

4. The liquid container according to claim 2, wherein the pull means comprises a flexible cord, said cord having one end connected to the said junction and having a pull device affixed to its other end, said pull device being inserted into the said one end of the straw.

5. The liquid container according to claim 1 wherein the pull device is non-circular in cross section and portions thereof engage at least one of said corrugations.

6. The liquid container according to claim 5 wherein the bendable section is bent to define a V-shaped angle and wherein at least a portion of the pull device is positioned within the straw at a location below the angle.

7. The liquid container according to claim 5 wherein at least a portion of the cross sectional configuration of the pull device is angular, the said angular portion engaging the corrugation.

8. In a liquid container of the type including an enclosing sidewall, a metallic top and an integral opener in the top wherein the opener comprises a pull tab which is defined in the top by a weakened seam, the improvement which comprises a straw packaged within the container below the top, said straw having one end adapted to be pulled above the top through an opening when the pull tab is removed to form the opening, said straw having a second end adapted to remain interiorly of the container for liquid sipping purposes;

pull means releasably interconnecting the pull tab to the straw to pull the said one end exteriorly of the container when the pull tab is separated from the container top along the said weakened seam;

the sidewall comprising a closure formed by a vertical seam and wherein the vertical seam is fabricated to define an integral metallic conduit, said conduit being hollow and extending from a location near the bottom of the container to below the container top, the said conduit being open at its bottom and at its top, the said second end of the straw being inserted into the open top of the conduit whereby liquid contents of the container can be extracted through the straw.

9. The liquid container according to claim 8 wherein said conduit is positioned adjacent the container sidewall.

10. The liquid container according to claim 8 wherein the the sidewall forms a part of the said conduit.

11. The liquid container according to claim 8 wherein the second end of the straw is frictionally retained in association with the top of the conduit.

12. The liquid container according to claim 11 wherein the straw comprises a bendable section.

13. The liquid container according to claim 12 wherein the pull means engages the straw upwardly of the bendable section.

14. The liquid container according to claim 12 wherein the bendable section comprises corrugations.

15. The liquid container according to claim 9 wherein the pull means removably engages the straw at the corrugations to pull the one end from the container when the pull tab is removed.

16. The liquid container of claim 15 wherein the pull means are flexible.

17. The liquid container according to claim 16 wherein the pull means comprise a flexible cord having two ends, one end of which is affixed to the pull tab.

18. The liquid container according to claim 17 and a pull device affixed to the other end of the flexible cord, said pull device being removably positioned interiorly of the straw.

19. The liquid container according to claim 18 wherein the pull device is non-circular in cross section and is in frictional engagement with at least a portion of the interior of the corrugations of the straw.

* * * * *